US006986305B2

(12) United States Patent
Knauer

(10) Patent No.: US 6,986,305 B2
(45) Date of Patent: Jan. 17, 2006

(54) WEB STABILIZATION FOR NON-CONTACT WEB GUIDANCE IN FLYING-CHANGE PRINTING UNITS

(75) Inventor: Peter Knauer, Münster/Lech (DE)

(73) Assignee: MAN Roland Druckmaschinen AG, Offenbach am Main (DE)

( * ) Notice: Subject to any disclaimer, the term of this patent is extended or adjusted under 35 U.S.C. 154(b) by 61 days.

(21) Appl. No.: 10/177,866

(22) Filed: Jun. 20, 2002

(65) Prior Publication Data

US 2003/0005836 A1 Jan. 9, 2003

(30) Foreign Application Priority Data

Jul. 3, 2001 (DE) ..... 101 32 156

(51) Int. Cl.
*B41F 5/04* (2006.01)
*B41F 13/02* (2006.01)

(52) U.S. Cl. ..... 101/220; 101/219; 242/615.2

(58) Field of Classification Search ..... 226/97.3, 226/196.1; 101/218, 220, 219, 247, 225, 101/227, 228; 242/615, 615.2
See application file for complete search history.

(56) References Cited

U.S. PATENT DOCUMENTS 2,764,087 A * 9/1956 Stobb ..... 101/181
3,780,925 A * 12/1973 Ternes ..... 226/191
5,443,008 A * 8/1995 Pavliny et al. ..... 101/484
5,615,610 A * 4/1997 Prohaska ..... 101/253
5,901,648 A 5/1999 Roland et al. ..... 101/218
5,924,619 A * 7/1999 Bartell ..... 226/7

FOREIGN PATENT DOCUMENTS

| | | |
|---|---|---|
| DE | G 85 10 912.6 | 2/1987 |
| DE | G 93 11 113.4 | 10/1993 |
| DE | 195 38 322 | 4/1997 |
| DE | 195 48 819 | 7/1997 |
| EP | 0 788 878 | 12/1996 |

* cited by examiner

*Primary Examiner*—Andrew H. Hirshfeld
*Assistant Examiner*—Leo T. Hinze
(74) *Attorney, Agent, or Firm*—Cohen, Pontani, Lieberman & Pavane

(57) ABSTRACT

The printing-material web is guided in the same position and plane when the transfer cylinders are moved apart for the flying printing-plate change, so that contact between the web and the transfer cylinders and smearing are avoided, that is to say undesired contact with ink-carrying parts. When the transfer cylinders are moved apart, web-guiding elements at the web inlet and/or web outlet support the printing-material web on both sides during the plate or sleeve change by supporting elements which are narrow or act at points and can be displaced transversely with respect to the printing-material web. The printing-material web continues to be guided in the same position and plane, and smearing is avoided.

12 Claims, 5 Drawing Sheets

WEB STABILIZATION FOR NON-CONTACT WEB GUIDANCE IN FLYING-CHANGE PRINTING UNITS

BACKGROUND OF THE INVENTION

1. Field of the Invention

The invention relates to a web-fed rotary offset printing machine having transfer cylinders mounted in sidewalls and web-guiding elements for guiding the web at the web inlet or the web outlet while the machine is running so that the transfer cylinders can be moved apart and a printing plate or a printing sleeve can be changed.

2. Description of the Related Art

DE-G 93 11 113 discloses a device in which the printing-material web is guided over two guide rolls, which are designed as cylindrical rollers. The guide rolls are mounted directly in the side walls of the printing units, so that there is no possibility of adjusting the guide rolls. The web stabilization and guidance is carried out by offsetting the web, the protective elements, in the form of continuous rolls, being effective over the entire web width. Setting these elements against or away from the printing-material web is not possible.

U.S. Pat. No. 5,901,648 discloses the practice of guiding a printing-material web by means of a two-part web-guiding element, which is also adjustable, when the transfer cylinders are moved apart. The protective elements extend over the entire web width. The protective elements are designed like fingers and, in their shape, correspond to the curvature of the surface of the two transfer cylinders arranged on either side of the printing-material web. It goes without saying that protective elements configured in this way are expensive.

SUMMARY OF THE INVENTION

It is the object of the invention to continue to guide the printing-material web in the same position and plane when the transfer cylinders are moved apart for the flying printing-plate change and to avoid contact between the same and the transfer cylinders, the intention being if possible to avoid smearing, that is to say undesired contact with ink-carrying parts.

According to the invention, the object is achieved by a plurality of supporting elements arranged transversely to the web on each side of the web, the supporting elements being moveable into contact with the web for supporting said web during changing of a printing plate or a printing sleeve, each supporting element acting on a narrow area parallel to the direction of travel of the web.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

DETAILED DESCRIPTION OF THE PRESENTLY PREFERRED EMBODIMENTS

Figure 1:
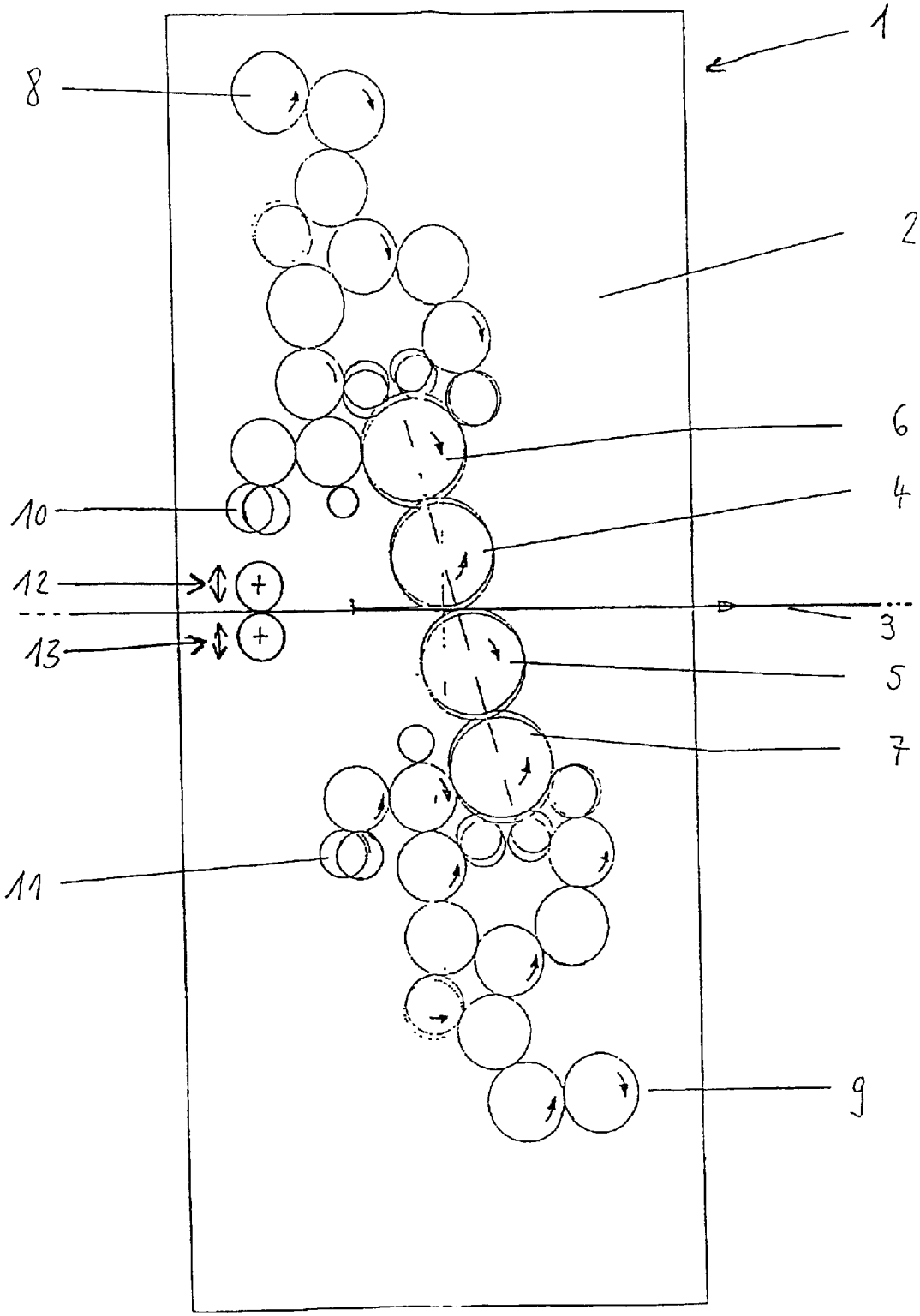
FIG. 1 is a schematic side view of a double printing unit having printing-material web-guiding elements.

In FIG. 1, the side view of a double printing unit is reproduced in schematic form.

A double printing unit (1) printing on both sides of a printing-material web (3) and designed as a four-cylinder printing unit in each case comprises a transfer cylinder (4, 5), printing-plate cylinder (6, 7), inking unit (8, 9) and damping unit (10, 11).

The transfer cylinders (4, 5) and printing-plate cylinders (6, 7) can be set away from each other and against each other individually and jointly.

Figure 2:
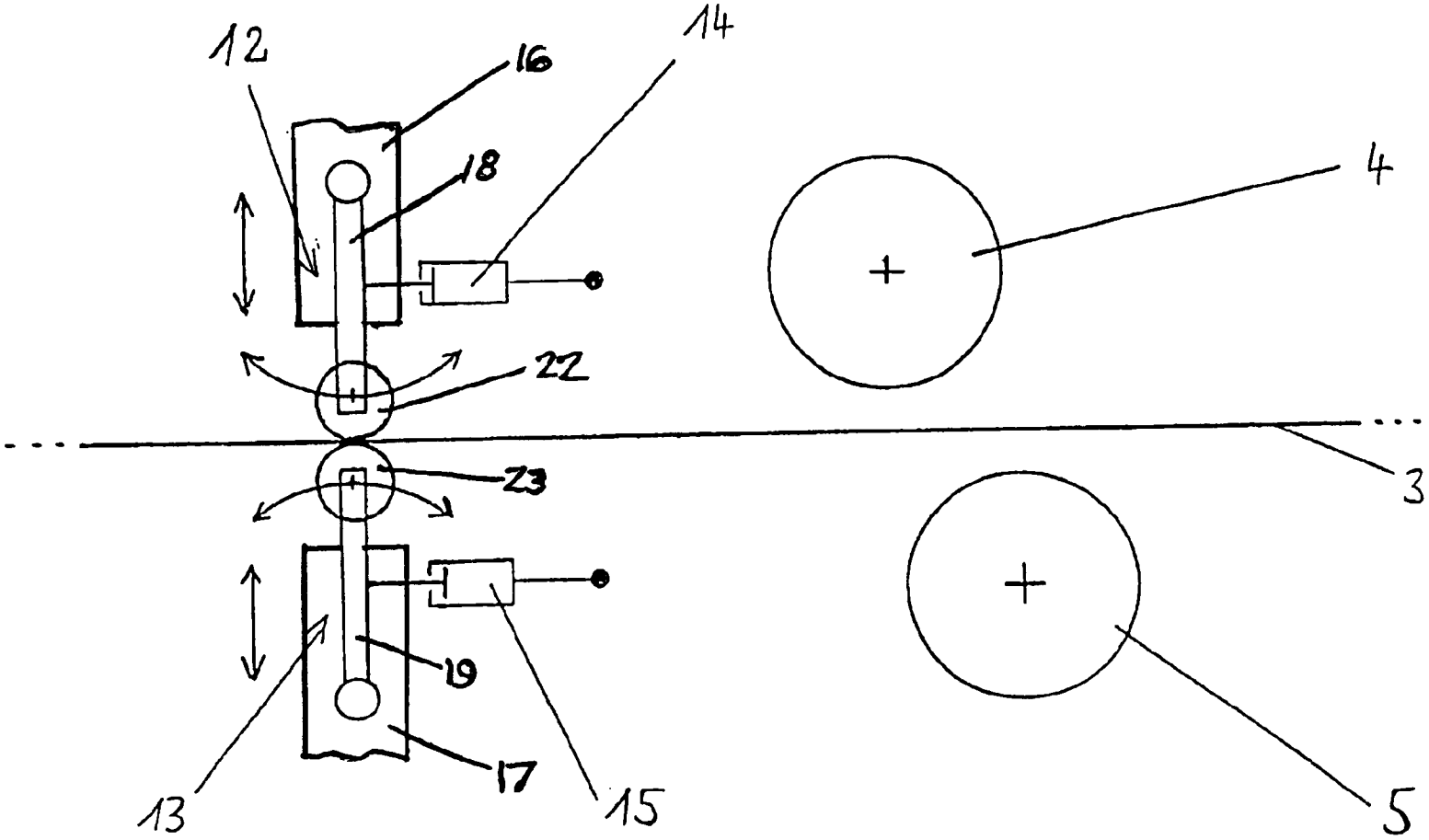
FIG. 2 shows web-guiding elements with an adjusting device on the web inlet side with parts of a double printing unit.

FIG. 2 shows the side view of web-guiding elements (12, 13) with an adjusting device (14, 15) on the web inlet side of a double printing unit with the transfer cylinders (4, 5) set away from each other.

In constructional terms, it is not necessary to place the web-guiding elements (12, 13) on the web inlet side, but it is recommended to position the web-guiding elements (12, 13) preferably upstream and/or downstream of the printing units. The transfer cylinders (4, 5) and the printing-plate cylinders (6, 7) represented in FIG. 1 are set away from each other in order to permit a flying printing-plate change, printing-plate or printing-sleeve or rubber-blanket change. Setting the transfer cylinders (4, 5) away from the printing-material web (3) means that the latter is no longer adequately guided and stabilized in its position. According to the invention, the printing-material web (3) continues to be guided in the same position and plane by setting the web-guiding elements (12, 13) on, in order to avoid contact between the printing-material web (3) and the transfer cylinders (4, 5).

The web-guiding elements (12, 13) are set against the printing-material web (3) by actuating devices (14, 15). The actuating devices (14, 15) can be pneumatic, hydraulic or electromechanical devices. The deflection of the actuating devices (14, 15) onto the web-guiding elements (12, 13) is carried out directly or via lever mechanisms, it being possible for a setting in relation to the printing-material web (3) to be carried out vertically, that is to say linearly or in a curve. With this variant of the arrangement, the web-guiding elements (12, 13) can be matched to printing materials of an extremely wide range of material thicknesses and consistencies.

Figure 3:
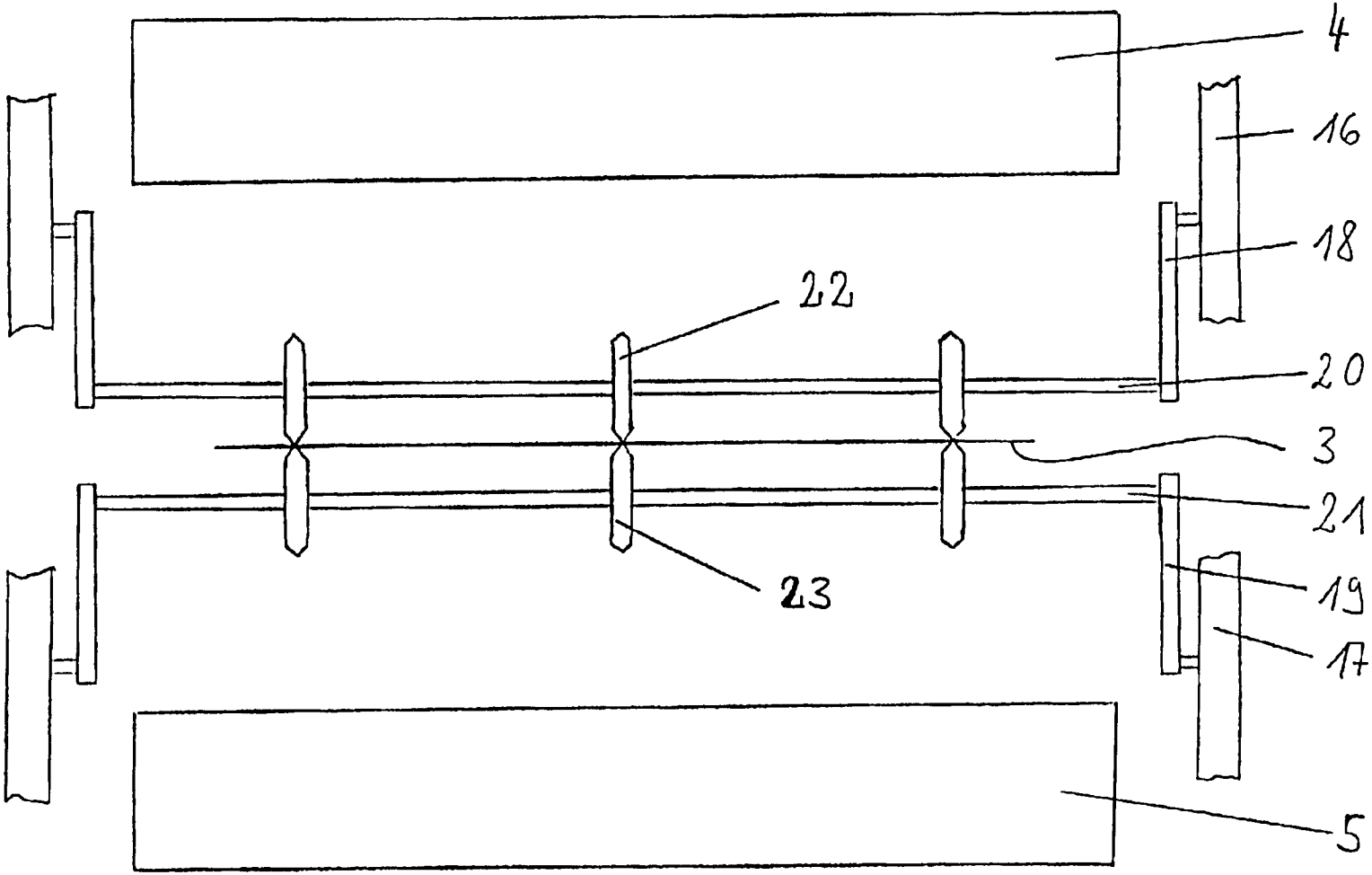
FIG. 3 shows web-guiding elements with disc-like supporting elements arranged opposite one another.

FIG. 3 shows web-guiding elements (16, 17, 18, 19, 20, 21, 22, 23) with supporting elements (22, 23) arranged opposite one another.

The actuating elements (18, 19) are rotatably mounted in displaceable frames (16, 17) which are mounted to the side walls (2), and can be set against the printing-material web (3) by means of a rotational movement or by means of a linear movement.

However, the actuating elements (18, 19) can also be permanently fitted to or mounted on the frames (16, 17), the setting of the supporting elements (22, 23) against the printing-material web (3) then being brought about via the displaceable frames (16, 17).

Figure 3A:
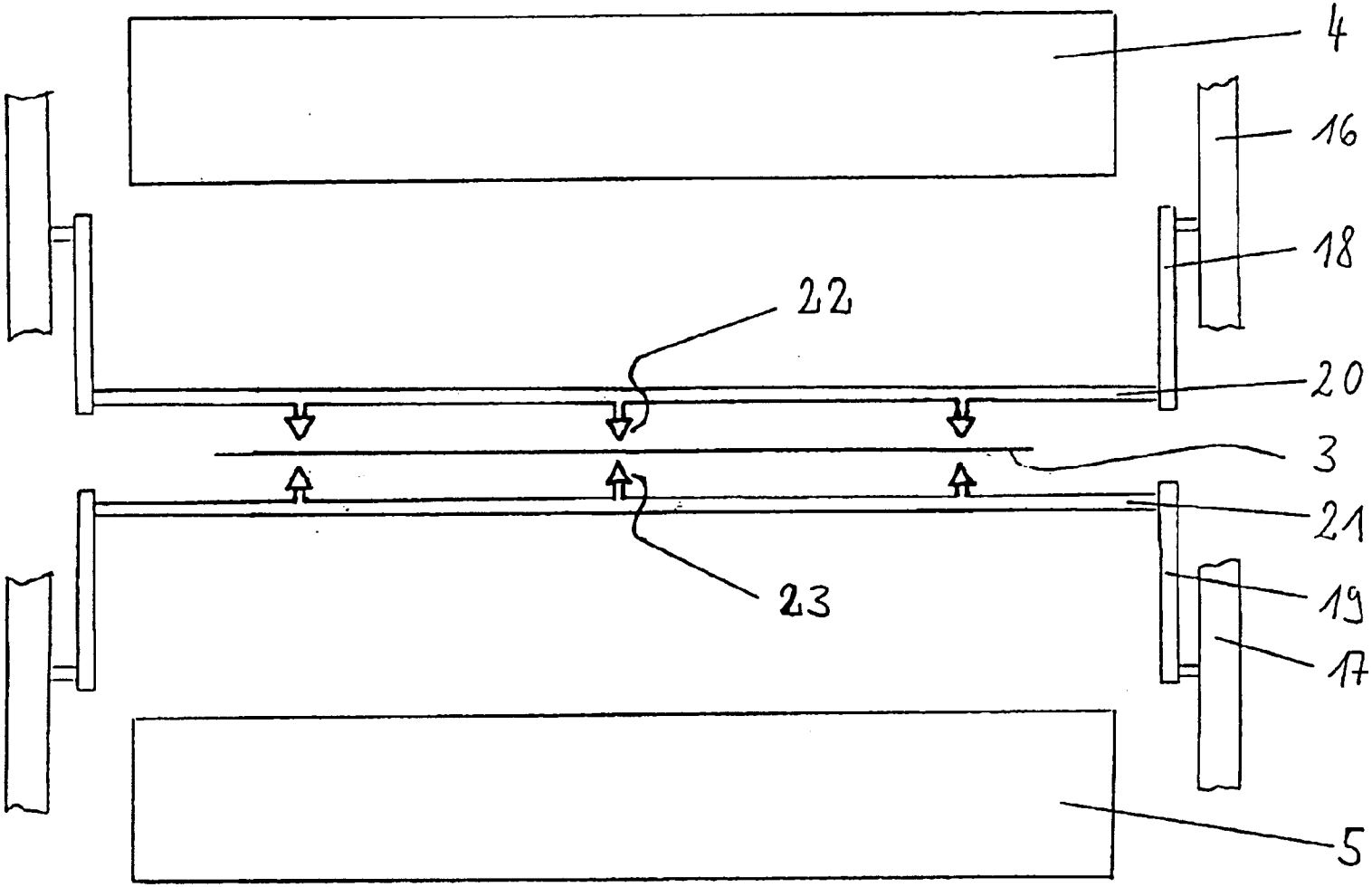
FIG. 3A shows web-guiding elements with nozzles arranged opposite to one another.

The frames (16, 17) can be moved toward the printing-material web (3) in a vertically linear manner or can be moved by means of a rotational or pivoting device. The positioning of the individual web-guiding elements (16, 17, 18, 19) is carried out by pneumatic, hydraulic or electromechanical actuating devices. The transfer of movement from the actuating devices to the web-guiding elements (16, 17, 18, 19) is carried out either directly, via lever mechanisms or gear mechanisms. The axles (20, 21) are mounted in the actuating elements (18, 19), the axles (20, 21) being rigid axles. The supporting elements (22, 23), disc-like elements (FIG. 3) or air nozzles (FIG. 3A), are displaceably mounted on the axle (20, 21) and, in their horizontal position, can be positioned over the entire width of the axles (20, 21) to print-free areas of the printing-material web (3). The web-guiding elements (16, 17, 18, 19, 20, 21, 22, 23) can thus be adapted to different print formats and printing-material web widths, in order to ensure optimal printing-material web guidance and support. The supporting elements (22, 23) can be positioned in their horizontal position in relation to the printing-material web (3) both individually and jointly, by means of a pneumatic, hydraulic or electropneumatic actuating device.

By means of these web-guiding elements (16, 17, 18, 19, 20, 21, 22, 23), the printing-material web (3) can be kept away from the surfaces of the transfer cylinders (4, 5), so that the web does not adhere to the surfaces of the transfer cylinders (4, 5) by way of ink residues adhering to these surfaces of the transfer cylinders (4, 5) and wind around the transfer cylinders (4, 5).

Since the supporting elements (22, 23) act only on print-free areas of the printing-material web, damage to the print, that is to say the smearing of ink from ink-carrying parts, can largely be ruled out. Since the printing-material web (3) is additionally supported point by point on both sides, and the supporting elements (22, 23) are set directly against the printing-material web (3), complete avoidance of printing and printing-material damage is achieved. In addition, by means of the use of numerous actuating devices, adjustable and uniform stabilization of the printing-material web (3) is made possible for the first time.

Figure 4:
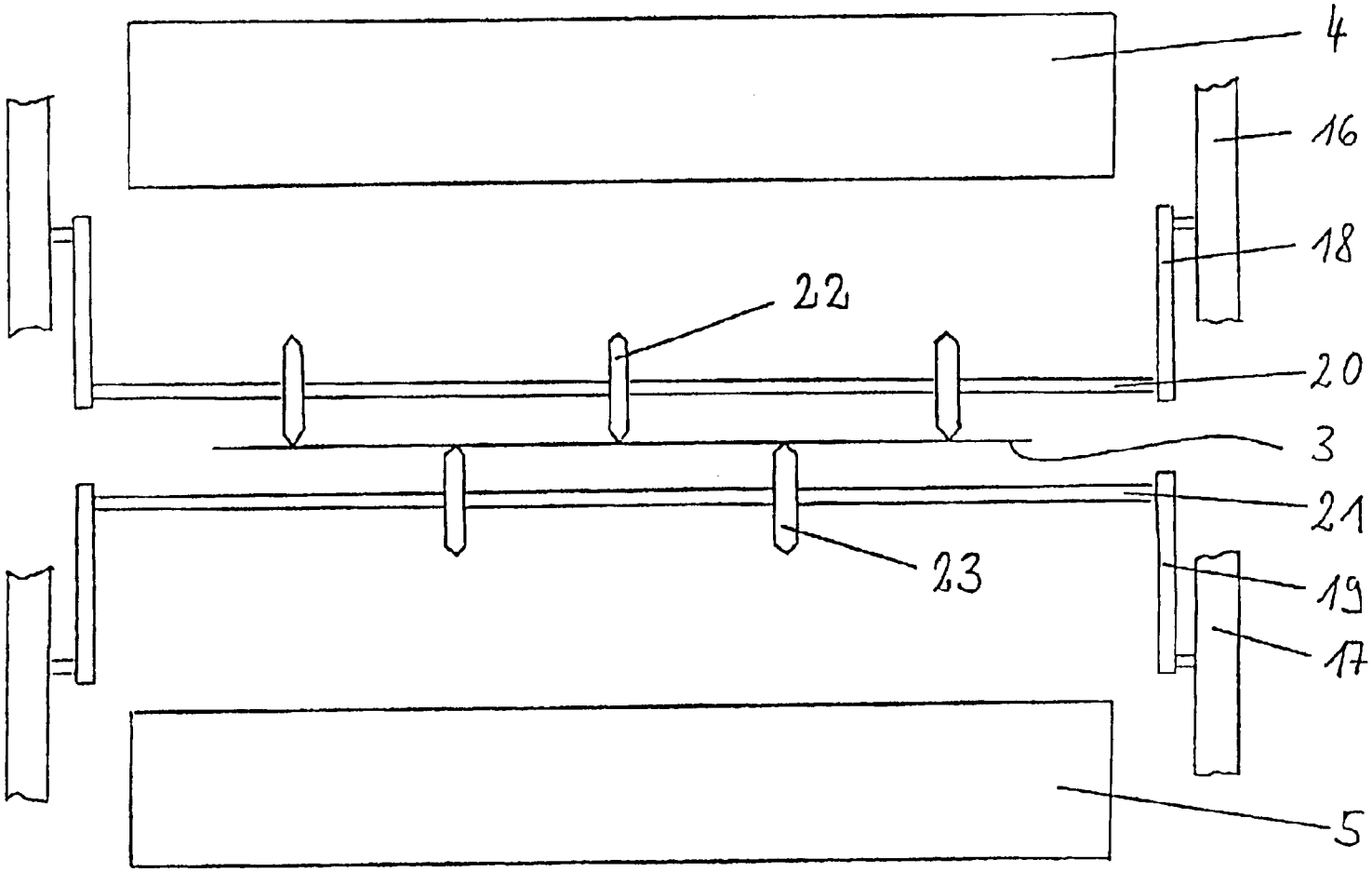
FIG. 4 shows web-guiding elements with supporting elements arranged to be offset from one another.

FIG. 4 shows web-guiding elements (16, 17, 18, 19, 20, 21, 22, 23) with supporting elements (22, 23) arranged to be offset in relation to one another. The explanation of the details relating to FIG. 4 is similar to FIG. 3, the supporting elements (22, 23) being arranged to be offset in relation to one another on the axle (20, 21).

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

I claim:

1. A web-fed rotary offset printing machine comprising a pair of side walls, a pair of opposed transfer cylinders mounted in said side walls, between which cylinders a web of printing material can be guided, said cylinders being moveable apart while the machine is running so that a printing plate or a printing sleeve can be changed, web guiding elements for guiding said web one of toward and away from said transfer cylinders, said web guiding elements comprising a plurality of supporting elements arranged transversely to the web on each side of the web, the supporting elements being displaceable transversely with respect to the web for supporting said web during changing of a printing plate or a printing sleeve while the web is moving, each said supporting element supporting said web substantially at a point, whereby said supporting elements can act only on narrow print-free areas which are parallel to the direction of travel of the web, and an axle on each side of said web, said supporting elements comprising disc-like elements fitted to said axles, said disc-like elements contacting said web when supporting said web.

2. A machine as in claim 1 wherein each said supporting element on one side of said web is arranged directly opposite from a supporting element on the other side of said web.

3. A machine as in claim 1 wherein each said supporting element on one side of said web is offset from supporting elements on the other side of said web.

4. A machine as in claim 1 further comprising actuating elements mounted to said side walls, said axles being mounted in said actuating elements.

5. A machine as in claim 4 further comprising frames mounted to said side walls, said actuating elements being mounted to said frames.

6. A machine as in claim 5 wherein said frames are moveable toward said web and away from said web.

7. A machine as in claim 6 wherein said frames can be moved linearly.

8. A machine as in claim 6 wherein said frames can be moved by pivoting.

9. A machine as in claim 4 comprising two pairs of actuating elements, each pair of actuating elements being mounted to respective said side walls in parallel.

10. A machine as in claim 1 wherein said supporting elements are positioned with respect to said web by a lever movement.

11. A machine as in claim 1 further comprising one of pneumatic, hydraulic, and electrical means for moving said supporting elements into position for supporting print-free areas of said web.

12. A machine as in claim 1 further comprising at least one actuating device for actuating said web-guiding elements, each said actuating device being one of a pneumatic device, a hydraulic device, and an electromechanical device.

* * * * *